United States Patent [19]

Frame

[11] 4,121,998

[45] Oct. 24, 1978

[54] TREATING A PETROLEUM DISTILLATE WITH A SUPPORTED METAL PHTHALOCYANINE AND A POLYNUCLEAR AROMATIC SULFONIC ACID

[75] Inventor: Robert R. Frame, Glenview, Ill.

[73] Assignee: UOP Inc., Des Plaines, Ill.

[21] Appl. No.: 870,388

[22] Filed: Jan. 18, 1978

Related U.S. Application Data

[63] Continuation-in-part of Ser. No. 756,578, Jan. 3, 1977.

[51] Int. Cl.[2] ..... C10G 27/06

[52] U.S. Cl. ..... 208/206; 252/428; 252/431 N

[58] Field of Search ..... 208/206, 207; 252/428, 252/431 N

[56] References Cited

U.S. PATENT DOCUMENTS

| | | | |
|---|---|---|---|
| 2,988,500 | 6/1961 | Gleim et al. | 208/206 |
| 3,409,543 | 11/1968 | Urban et al. | 208/206 |
| 3,445,380 | 5/1969 | Urban | 208/206 |
| 4,070,307 | 1/1978 | Carlson | 208/206 |

*Primary Examiner*—George Crasanakis

*Attorney, Agent, or Firm*—James R. Hoatson, Jr.; Robert W. Welch; William H. Page, II

[57] ABSTRACT

A process for treating a mercaptan-containing sour petroleum distillate is disclosed. The process comprises contacting the distillate with a catalytic composite in the presence of an alkaline reagent at oxidation conditions. The catalytic composite comprises a solid adsorptive support impregnated with a polynuclear aromatic sulfonic acid and a metal phthalocyanine.

11 Claims, 3 Drawing Figures

Figure 1:
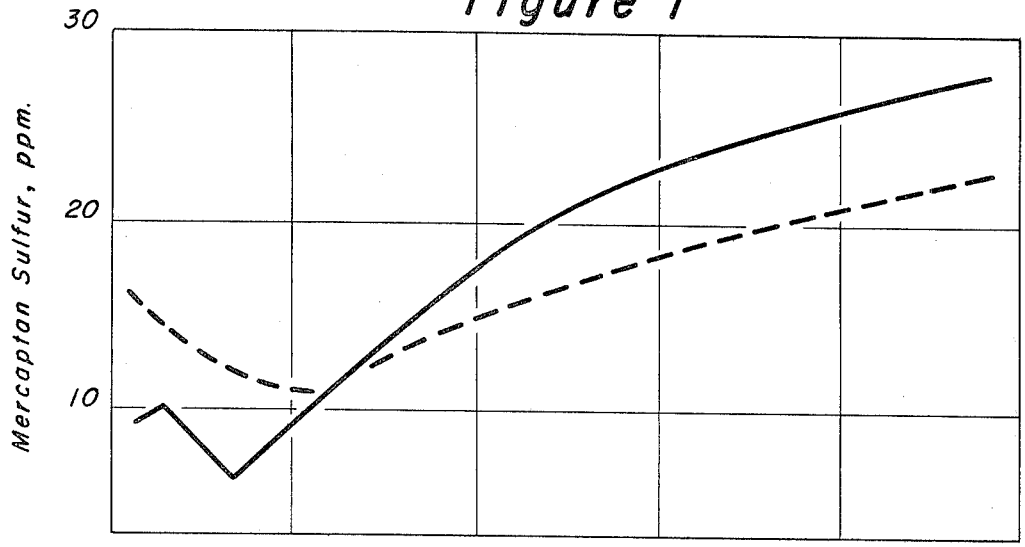

TREATING A PETROLEUM DISTILLATE WITH A SUPPORTED METAL PHTHALOCYANINE AND A POLYNUCLEAR AROMATIC SULFONIC ACID

CROSS-REFERENCE TO RELATED APPLICATIONS

This application is a continuation-in-part of a copending application Ser. No. 756,578 filed Jan. 3, 1977.

This invention relates to a process for treating a mercaptan-containing sour petroleum distillate or fraction. Processes for the treatment of sour petroleum distillates wherein the distillate is passed in contact with a supported metal phthalocyanine catalyst disposed as a fixed bed in a treating or reaction zone, have become well known and widely practiced in the industry. The treating process is typically designed to effect the catalytic oxidation of offesive mercaptans contained in the sour distillate with the formation of innocuous disulfides. The oxidizing agent is most often air admixed with the distillate to be treated. Gasoline, including natural, straight run and cracked gasoline, is the most frequently treated distillate. Other petroleum distillates include the normally gaseous petroleum fractions as well as naphtha, kerosene, jet fuel, fuel oil, lube oil, and the like.

The petroleum distillate so treated will invariably comprise one or more catalyst deactivating agents, frequently referred to as toxins. These toxins are usually phenolic materials and higher molecular weight aliphatic, naphthenic, and condensed ring aromatic acids which deposit and accumulate on the catalyst surface to promote catalyst activity instability and premature deactivation.

It is an object of this invention to present a process for treating a sour petroleum distillate in contact with a catalytic composite of improved activity stability.

In one of its broad aspects, the present invention embodies a process for treating a mercaptan-containing sour petroleum distillate which comprises contacting said distillate with a catalytic composite in the presence of an alkaline reagent at oxidation conditions, said catalytic composite comprising a solid adsorptive support impregnated with from about 0.1 to about 25 wt. % polynuclear aromatic sulfonic acid, and from about 0.1 to about 10 wt. % metal phthalocyanine.

One of the more specific embodiments concerns a process for treating said distillate which comprises contacting said distillate with a catalytic composite in the presence of an aqueous sodium hydroxide solution at oxidation conditions, said catalytic composite comprising an activated charcoal support impregnated with from about 0.1 to about 25 wt. % naphthalenesulfonic acid, and from about 0.1 to about 10 wt. % metal phthalocyanine.

A still more specific embodiment of this invention relates to a process for treating a mercaptan-containing sour petroleum distillate which comprises contacting said distillate with a catalytic composite in the presence of an aqueous sodium hydroxide solution at oxidation conditions, said catalytic composite comprising an activated charcoal support impregnated with from about 0.1 to about 25 wt. % 7-amino-1,3-naphthalenedisulfonic acid, and from about 0.1 to about 10 wt. % cobalt phthalocyanine monosulfonate.

Other objects and embodiments of this invention will become apparent in the following detailed specification.

While it is not intended to limit or restrict the present invention by any particular theory, it is contemplated that the improved activity stability exhibited by the catalytic composite of this invention is due at least in part to the polynuclear aromatic sulfonic acid component which occupies sites on the adsorbent support which are susceptible to toxin retention, which sites would otherwise be available during treatment of a sour petroleum distillate and become occupied by toxins having a substantially greater deactivating influence on the catalyst.

The solid adsorbent supports herein contemplated include the various and well known solid adsorbent materials in general use as catalyst supports. Preferred adsorbent materials include the various charcoals produced by the destructive distillation of wood, peat, lignite, nut shells, bones, and other carbonaceous matter, and preferably such charcoals as have been heat treated, or chemically treated, or both, to form a highly porous particle structure of increased adsorbent capacity, and generally defined as activated charcoal. Said adsorbent materials also include the naturally occurring clays and silicates, for example, diatomaceous earth, fuller's earth, kieselguhr, attapulgus clay, feldspar, montmorillonite, halloysite, kaolin, and the like, and also the naturally occuring or synthetically prepared refractory inorganic oxides such as alumina, silica, zirconia, thoria, boria, etc., or combinations thereof, like silica-alumina, silica-zirconia, alumina-zirconia, etc. Any particular solid adsorbent material is selected with regard to its stability under conditions of its intended use. For example, in the treatment of a sour petroleum distillate, the solid adsorbent material should be insoluble in, and otherwise inert to, the aqueous caustic solution and the petroleum distillate at conditions existing in the treating zone. In the latter case, charcoal, and particularly activated charcoal, is preferred because of its capacity for metal phthalocyanine and because of its stability under treating conditions. However, it should be observed that any of the other well-known solid adsorbent carrier materials, particularly the refractory inorganic oxides, may be employed.

The commercially available polynuclear aromatic sulfonic acids, particularly the commercially available naphthalenesulfonic acids, will frequently comprise one or more substituent or functional groups, for example, amino, hydroxyl, carboxyl, and the like, but such substituted polynuclear aromatic sulfonic acids will nevertheless effect an improved activity stability as herein contemplated. Suitable polynuclear aromatic sulfonic acids therefore not only include 1-naphthalenesulfonic acid, 2-naphthalenesulfonic acid, 1,5-naphthalenedisulfonic acid, 1,6-naphthalenedisulfonic acid, 2,7-naphthalenedisulfonic acid, 2-phenanthrenesulfonic acid, 3-phenanthrenesulfonic acid, 9-phenanthrenesulfonic acid, 1-anthracenesulfonic acid, 2-anthracenesulfonic acid, and the like, but also 4-amino-1-naphthalenesulfonic acid, 7-amino-1-naphthalenesulfonic acid, 4-amino-2-naphthalenesulfonic acid, 4-amino-5-naphthalenesulfonic acid, 1-hydroxy-2-naphthalenesulfonic acid, 1-hydroxy-4-naphthalenesulfonic acid, 1-hydroxy-5-naphthalenesulfonic acid, 2-hydroxy-1-naphthalenesulfonic acid, 2-hydroxy-6-naphthalenesulfonic acid, 2-hydroxy-7-naphthalenesulfonic acid, 2-hydroxy8-naphthalenesulfonic acid, 4-hydroxy-1-naphthalenesulfonic acid, 5-hydroxy1-naphthalenesulfonic acid, 7-hydroxy-1-naphthalenesulfonic acid, 8-hydroxy-1-naphthalenesulfonic acid, 6-hydroxy-2-naphthalenesulfonic acid, 7-hydroxy2-naphthalenesulfonic acid, 7-amino-1,3-naphthalenedisulfonic acid, 4-amino5-hydroxy-2,7-naphthalenedisulfonic acid, 4,5-dihydroxy-2,7-naphthalenedisulfonic acid, 7-hydroxy-1,3-naphthalenedisulfonic acid, 3-hydroxy-2,7-naphthalenedisulfonic acid, 1-hydroxy-3,6-naphthalenedisulfonic acid, 1-hydroxy-4,8-naphthalenedisulfonic acid, 2-hydroxy-3,6-naphthalenedisulfonic acid, 2-hydroxy-6,8-naphthalenedisulfonic acid, 1,3,6-naphthalenetrisulfonic acid, and the like.

Impregnation of the support with the selected polynuclear aromatic sulfonic acid can be effected in any conventional or otherwise convenient manner. Thus, the support or carrier material, in the form of spheres, pills, pellets, granules, or other particles of uniform or irregular shape, is soaked, dipped, suspended or otherwise immersed in a solution of said sulfonic acid. The impregnating solution is suitably an aqueous and/or alcoholic solution, and in some cases, solubility of the sulfonic acid is enhanced by the inclusion of an alkaline material, for example sodium hydroxide. The polynuclear aromatic sulfonic acid concentration is such as to provide a final catalytic composite comprising from about 0.1 to about 25 wt. % polynuclear aromatic sulfonic acid. The impregnated support may be allowed to dry at room temperature, dried in an oven, or in a flow of hot gases, or in any other suitable manner.

The support is further impregnated with from about 0.1 to about 10 wt. % metal phthalocyanine. The catalytic composite of this invention may comprise any of the various metal phthalocyanines heretofore disclosed, for example, magnesium, titanium, hafnium, vanadium, tantalum, molybdenum, manganese, iron, cobalt, nickel, platinum, palladium, copper, silver, zinc and tin phthalocyanine, and the like. Cobalt phthalocyanine and vanadium phthalocyanine are particularly preferred metal phthalocyanines. The metal phthalocyanine is preferably employed herein as a derivative thereof, the commercially available sulfonated derivatives, for example, cobalt phthalocyanine monosulfonate, cobalt phthalocyanine disulfonate, or mixtures thereof, being particularly preferred. The sulfonated derivatives may be prepared, for example, by reacting cobalt, vanadium or other metal phthalocyanine with fuming sulfuric acid. While the sulfonated derivatives are preferred, it is understood that other derivatives, particularly the carboxylated derivatives, may be employed. The carboxylated derivatives are readily prepared by the action of trichloroacetic acid on the metal phthalocyanine or by the action of phosgene and aluminum chloride. In the latter reaction, the acid chloride is formed and may be converted to the desired carboxylated derivative by conventional hydrolysis.

The support can be impregnated with the metal phthalocyanine in any conventional or otherwise convenient manner. In general, the support or carrier material is dipped, soaked, suspended, or otherwise immersed in the described aqueous dispersion, or the aqueous dispersion may be sprayed onto, poured over, or otherwise contacted with the adsorbent support. In any case, the excess solution and/or dispersion is separated and the resulting composite allowed to dry under ambient temperature conditions, or dried at an elevated temperature in an oven, or in a flow of hot gases, or in any other suitable manner.

It is generally preferable to adsorb as much metal phthalocyanine on the adsorbent support as will form a stable catalytic composite— generally up to about 25 wt. %, although a lesser amount in the range of from about 0.1 to about 10 wt. % affords a suitably active catalyst. One suitable and convenient method comprises predisposing the solid support in a distillate treating zone or chamber as a fixed bed, and passing the aqueous metal phthalocyanine dispersion through the bed in order to form the catalyst in situ. This method allows the aqueous dispersion to be recycled one or more times to achieve a desired concentration of the metal phthalocyanine on the adsorbent support. In still another method, the adsorbent support may be predisposed in said treating chamber and the chamber thereafter filled with the aqueous metal phthalocyanine dispersion to soak the support for a predetermined period, thereby forming the catalytic composite in situ.

In the sweetening process herein contemplated, the offensive mercaptans contained in a sour petroleum distillate are oxidized to form disulfides. This oxidation reaction is typically effected in the presence of an alkaline reagent. One suitable alkaline reagent is tetraalkylammonium hydroxide, and said tetraalkylammonium hydroxide reagent can be derived from the reaction of, for example, methyl iodide and 7-amino-1,3-naphthalenedisulfonic acid, and formed securely bound to the support during the first mentioned impregnation step. More often, the alkaline reagent is admixed with the sour distillate and the mixture passed in contact with the catalyst. While any suitable alkaline reagent may be employed, an aqueous caustic solution is in this case preferred. Other suitable alkaline solutions particularly include aqueous potassium hydroxide solutions, but also aqueous solutions of lithium hydroxide, rubidium hydroxide, and cesium hydroxide. Similarly, while water is a preferred solvent for the alkaline reagent, other solvents may be employed including, for example, alcohols, and especially methanol, ethanol, propanol, butanol, etc., and ketones, including acetone, methylethyl ketone, etc. In some cases, the treating is effected in the presence of both an aqueous solution of the alkaline reagent and an alcohol, particularly methanol or ethanol, or solutizers or solubilizers including, for example, phenols, cresols, butyric acid, etc.

The sweetening process is usually effected at ambient temperature conditions although elevated temperatures not in excess of about 150° C. may be used. The process may be effected at a pressure of up to about 1000 psi, or more, although atmospheric, or substantially atmospheric, pressures are entirely suitable. Contact times equivalent to a liquid hourly space velocity of from about 1 to about 100 or more are effective to achieve a desired reduction in the mercaptan content of a sour petroleum distillate, an optimum contact time being dependent on the size of the treating zone, the quantity of catalyst contained therein and the sour petroleum distillate being treated.

As previously stated, sweetening of the sour petroleum distillate is effected by oxidizing the mercaptan content thereof to disulfides. Accordingly, the process is effected in the presence of an oxidizing agent, preferably air, although oxygen or other oxygen-containing agents may be employed. The mixture of petroleum distillate, alkaline reagent and oxidizing agent is passed upwardly or downwardly through the catalyst bed. In some cases, the air may be passed countercurrent to the petroleum distillate. In still other cases, the petroleum distillate and alkaline reagent may be introduced separately into the treating zone.

In many cases, the sour petroleum distillate, and especially gasoline, is first treated with an alkaline reagent solution in order to remove a major portion of the mercaptan prior to further treating in the manner hereinbefore described. Any suitable alkaline reagent, and particularly sodium hydroxide or potassium hydroxide, is utilized. This removes a major portion of the mercaptans but leaves a distillate which is still sour. Further conversion of the mercaptans is effected in the presence of the catalytic composite herein described.

The catalytic composite prepared in accordance with the method of this invention is both active and stable. Accordingly, the catalytic composite may be employed in a fixed bed for the treatment of large volumes of sour petroleum distillate. Although the metal phthalocyanine is somewhat soluble in alkaline solution, it is nevertheless retained on the solid adsorbent support. However, in the event that any of the metal phthalocyanine is leached from the support, or otherwise carried away in the alkaline solution, it may be readily recycled in said solution for reuse in the sweetening process. However, it is in some cases desirable to introduce additional metal phthalocyanine for adsorption on the solid support in the manner herein described.

The following examples are presented in illustration of certain preferred embodiments of this invention and are not intended as an undue limitation on the generally broad scope of the invention as set out in the appended claims.

EXAMPLE I

The charcoal utilized as a support for cobalt phthalocyanine monosulfonate in this and subsequent examples was an activated charcoal having a particle size in the 10 × 30 mesh range, and an average bulk density of about 0.41 gms/cc. The charcoal is commercially available under the Darco trademark. In this example, the charcoal was first impregnated with 7-amino-1,3-naphthalenedisulfonic acid. Impregnation was effected by immersing about 300 cc of the charcoal particles in a near boiling solution of 7-amino-1,3-naphthalenedisulfonic acid (35 gms) and 10 ml of 8% sodium hydroxide solution in 75 ml of water and 500 ml of methanol. The mixture was cooled and allowed to age for about 5 days at room temperature (about 22° C.). The solution was thereafter decanted from the charcoal, and the charcoal was washed with methanol and dried at 100°–110° C. About 120 cc of the impregnated charcoal was then immersed in 300 ml of methanol containing 0.18 gms of cobalt phthalocyanine monosulfonate and allowed to soak for about 24 hours at room temperature. The impregnated charcoal was recovered, washed with methanol and dried to provide a catalyst comprising 0.6 wt. % cobalt phthalocyanine monosulfonate.

EXAMPLE II

A standard or conventional catalyst was prepared substantially as described in Example I except that the polynuclear aromatic sulfonic acid component was omitted. Thus, about 120 cc of the charcoal particles were immersed in 300 ml of methanol containing 0.18 gms of cobalt phthalocyanine monosulfonate and soaked therein for about 24 hours at room temperature. The impregnated charcoal was thereafter washed with methanol and dried to provide a catalyst comprising about 0.6 wt. % cobalt phthalocyanine monosulfonate.

The catalyst of Example I was subjected to a comparative evaluation test relative to the standard catalyst of Example II. In each case, 100 cc of the catalyst was disposed as a fixed bed in a vertical tubular reactor maintained at 55° C. Previous to the start of each test, the catalyst bed was washed with 10 Be aqueous sodium hydroxide solution, and the catalyst bed was further washed with 10 ml of said solution at 12 hour intervals during the test. Air was admixed with a sour kerosene feed stock at 80 psig to provide about 3.2 times the needed amount to oxidize the mercaptan content of the feed stock, and the mixture was processed through the catalyst bed at a 0.5 liquid hourly space velocity over a 450–500 hour period. The kerosene feed stock contained 500 ppm mercaptan sulfur. The reactor effluent was monitored and analyzed periodically for mercaptan sulfur. The test results are set out in FIG. 1 of the attached drawing.

EXAMPLE III

In this example, the charcoal was impregnated with 7-amino-1,3-naphthalenedisulfonic acid. Impregnation was effected by immersing about 300 cc of the charcoal particles in a solution comprising the reaction product of 7-amino-1,3-naphthalenedisulfonic acid (35 gms) and methyl iodide (70 gms) in 75 ml of water and 500 ml of methanol. The mixture was aged at room temperature for about 5 days with intermittent stirring, and the solution thereafter decanted from the charcoal. The recovered charcoal was washed with methanol and dried. About 150 cc of the impregnated charcoal was further washed with 500 ml of an 8% aqueous sodium hydroxide solution, and again washed with methanol and dried. The impregnated charcoal was then immersed and allowed to soak in 300 ml of methanol containing 0.15 gms of cobalt phthalocyanine monosulfonate for about 24 hours at room temperature. The impregnated charcoal product was recovered, washed with methanol and dried to yield a catalyst comprising about 0.6 wt. % cobalt phthalocyanine monosulfonate.

The catalyst of Example III was subjected to the described comparative evaluation test relative to the standard catalyst of Example II. The test conditions were as described except that air was admixed with the sour kerosene feed stock at 65 psig to provide about 2.6 times the amount required to oxidize the mercaptans present in said feed stock. The test results are set out in FIG. 2 of the attached drawing.

EXAMPLE IV

About 300 cc of the charcoal particles were impregnated with 2-hydroxy-6-naphthalenesulfonic acid by immersing the particles in a near boiling solution of 2-hydroxy-6-naphthalenesulfonic acid (26 gms) and 300 ml of water containing 20 ml of 8% aqueous sodium hydroxide solution. The resulting solution was cooled and aged for about 5 days at room temperature with occasional stirring. The liquid phase was then decanted from the charcoal, and the charcoal was washed with methanol and dried. About 150 cc of the impregnated charcoal was subsequently further impregnated with 0.15 gms of cobalt phthalocyanine monosulfonate. Impregnation was by soaking the charcoal for about 24 hours at room temperature and 300 ml of methanol containing 0.15 gms of cobalt phthalocyanine monosulfonate. The impregnated charcoal product recovered from the impregnating solution was washed with methanol and dried. The catalyst product contained 0.6 wt. % cobalt phthalocyanine monosulfonate.

The catalyst of Example IV was subjected to the described comparative evaluation test relative to the standard catalyst of Example II. The test conditions were as described except that air was admixed with the sour kerosene feed stock at 45 psig to provide about 1.9 times the amount required to oxidize the mercaptans present in said feed stock. The test results are set out in FIG. 3 of the attached drawing.

Figure 2:
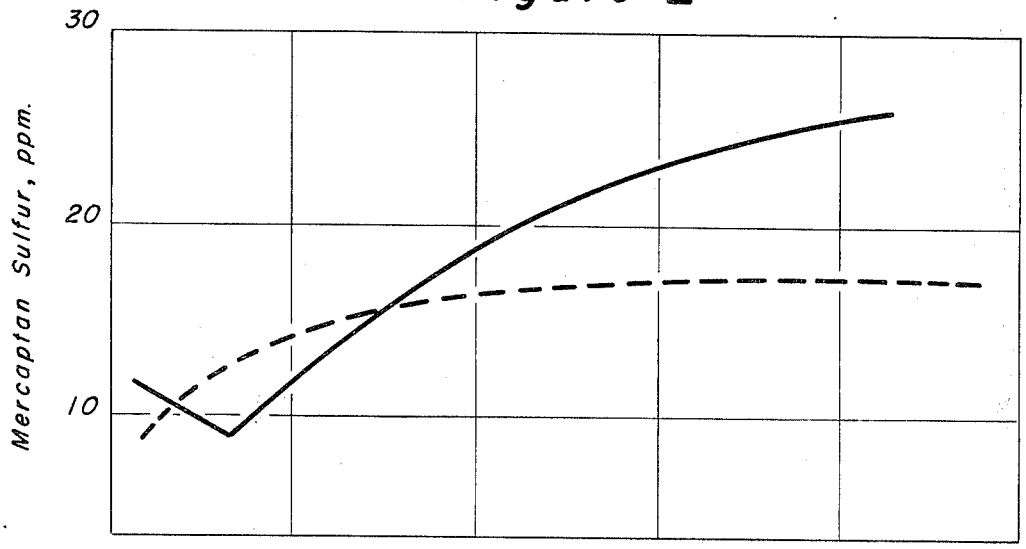
Figure 3:
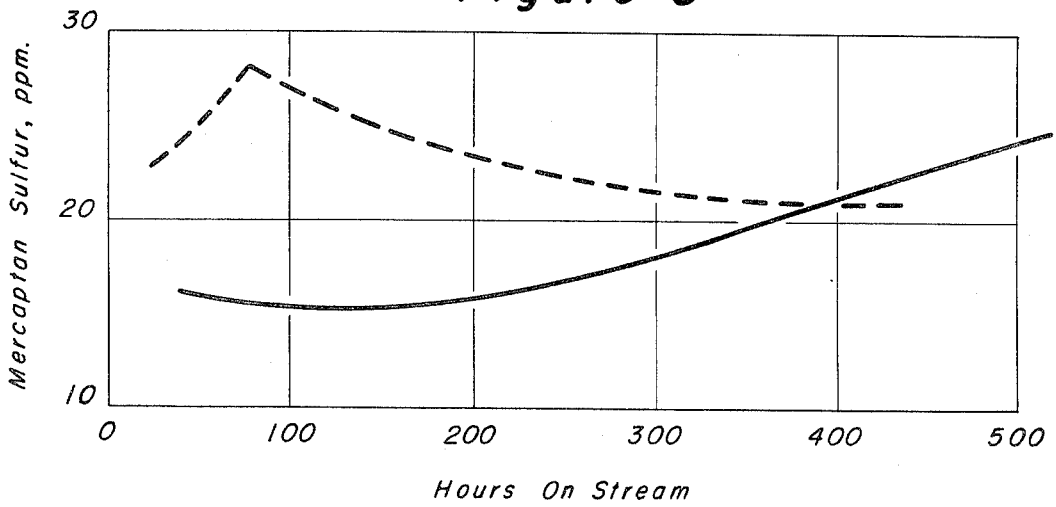

FIGS. 1, 2 and 3 of the attached drawing clearly illustrate the improved activity stability exhibited by the catalytic composites of this invention—the improved activity stability being conducive to longer catalyst life. While said catalyst composites may be initially less active than the standard or conventional catalysts (as might be expected in view of the toxin-free character of the fresh standard or conventional catalysts), the improved activity stability characteristics of the catalytic composites of this invention affects a reversal of the initial activity advantage at a relatively early stage in the mercaptan oxidation process.

I claim as my invention:

1. A process for treating a mercaptan-containing sour petroleum distillate which comprises contacting said distillate with a catalytic composite in the presence of an alkaline reagent at oxidation conditions to oxidize the mercaptan present in said distillate, said catalytic composite comprising a solid adsorptive support impregnated with from about 0.1 to about 25 wt. % polynuclear aromatic sulfonic acid and from about 0.1 to about 10 wt. % metal phthalocyanine.

2. The process of claim 1 further characterized in that said adsorptive support is an activated charcoal.

3. The process of claim 1 further characterized in that said polynuclear aromatic sulfonic acid is a naphthalenesulfonic acid.

4. The process of claim 1 further characterized in that said polynuclear aromatic sulfonic acid is a naphthalenedisulfonic acid.

5. The process of claim 1 further characterized in that said polynuclear aromatic sulfonic acid is an amino substituted polynuclear aromatic sulfonic acid.

6. The process of claim 1 further characterized in that said polynuclear aromatic sulfonic acid is a hydroxy substituted polynuclear aromatic sulfonic acid.

7. The process of claim 1 further characterized in that said metal phthalocyanine is a sulfonated metal phthalocyanine.

8. The process of claim 1 further characterized in that said metal phthalocyanine is a carboxylated metal phthalocyanine.

9. The process of claim 1 further characterized in that said metal phthalocyanine is cobalt phthalocyanine.

10. The process of claim 1 further characterized in that said metal phthalocyanine is vanadium phthalocyanine.

11. The process of claim 1 further characterized in that said alkaline reagent is sodium hydroxide in from about a 2 wt. % to about a 30 wt. % aqueous solution.

* * * * *